US006321504B1

(12) United States Patent
Svensson

(10) Patent No.: US 6,321,504 B1
(45) Date of Patent: Nov. 27, 2001

(54) PRE-MANUFACTURED ROOF PLATE ELEMENT AND GIRDER THERETO

(76) Inventor: Peehr Mathias Ornfeldt Svensson, Vroldvej 174, DK-8660 Skanderborg (DK)

( * ) Notice: Subject to any disclaimer, the term of this patent is extended or adjusted under 35 U.S.C. 154(b) by 0 days.

(21) Appl. No.: 09/423,181

(22) PCT Filed: Apr. 30, 1998

(86) PCT No.: PCT/DK98/00170

§ 371 Date: Nov. 3, 1999

§ 102(e) Date: Nov. 3, 1999

(87) PCT Pub. No.: WO98/50647

PCT Pub. Date: Nov. 12, 1998

(30) Foreign Application Priority Data

May 6, 1997 (DK) ..... 0524/97

(51) Int. Cl.[7] ..... E04C 3/30

(52) U.S. Cl. ..... 52/737.1; 52/737.2; 52/737.6; 52/783.11

(58) Field of Search ..... 52/408, 409, 407.3, 52/737.1, 737.2, 737.6, 783.11, 731.2, 731.1, 970.1, 479, 480, 180, 198, 220.4

(56) References Cited

U.S. PATENT DOCUMENTS 2,233,291 * 2/1941 Leebov ..... 52/737.1
2,388,968 * 11/1945 Hedgren ..... 52/737.1
2,910,152 * 10/1959 Edgar ..... 52/737.1
3,102,611 9/1963 Mote .
3,228,162 * 1/1966 Gregoire ..... 52/309
3,300,912 * 1/1967 Shumaker ..... 52/737.1
4,125,977 11/1978 Michlovic .

FOREIGN PATENT DOCUMENTS

92/19826 11/1992 (WO) .

* cited by examiner

*Primary Examiner*—Beth A. Stephan
*Assistant Examiner*—Dennis L. Dorsey
(74) *Attorney, Agent, or Firm*—Ladas & Parry

(57) ABSTRACT

A pre-manufactured roof plate element comprising a number of longitudinal box-shaped girders of steel plate, which are upwardly connected with a compressive force plate with almost the same width as the girder, and which preferably are positioned in each side and in the middle of the element. The compressive force plate consists of a corrugated steel plate having a preferably trapezoid shape. A box-shaped girder of the said type is a complement to the roof plate element. A roof plate element or a girder according to the invention may be produced totally without use of organic material.

8 Claims, 2 Drawing Sheets

PRE-MANUFACTURED ROOF PLATE ELEMENT AND GIRDER THERETO

FIELD OF THE INVENTION

The present invention relates to a pre-manufactured roof plate element of the type described herein.

BACKGROUND ART

DE-A1-25 20 255 describes a light building element composed of construction elements, in which roofing plates and stiffening constitute an integrated unit, such as a pre-manufactured roof plate element, each consisting of at least one open basic profile glued directly on an upper cover plate constituting both covering and load compressive element, and where the cover plate is broader than the basic profile and extends outside the basic profile along both longitudinal edges.

EP-A1-0 675 990 (WO 92/19826) discloses a premanufactured roof plate element comprising three boxshaped, carrying basic profiles of steel plate, which upwardly is directly connected with a compressive force plate consisting of strong construction plywood, and having the same width as the basic profiles, which are placed along opposite long sides and in the middle of the roof plate element.

Common for these known light roof plate elements is, that they have a relative large overall height, which during manufacturing, storage and transport cause extraordinary large demands for space. Also by projecting and the construction work it is inexpedient, that the overall height of the roof plate element itself is large, as it causes extra costs for obtaining extra free height.

The invention has for its purpose to provide an improved premanufactured roof plate element of the type mentioned in the introductory part, and which by means of simple provisions makes it possible to reduce the overall height of the roof plate element itself.

The roof plate element according to the invention is distinctive in that said compressive force plate consists of a steel plate, which—seen in cross section—is corrugated. By means of simple provisions it is hereby obtained, that it becomes possible to reduce the overall height and the weight of the roof plate element, which may result in considerable savings by transport and storage of finished pre-manufactured roof plate elements. However, it is of most importance that a roof plate element according to the invention may be produced totally without use of organic material. In order to further reduce the overall height of the roof plate element itself, it may be advantageously, that also a bottom side part of said boxshaped girders—seen in a cross section—also is corrugated.

In order to give the boxshaped girder by the roof plate element according to the invention better side stability it may be appropriately, that said compressive force steel plate has longitudinal, folded side edges extending downwards along opposite vertical sides of the girder.

The roof plate element according to the invention may be such provided that the corrugation of said compressive force plate is trapezoid, or the corrugation may be wave-shaped. Besides the same concerns said bottom side part of the girder. By corrugation of top and bottom side parts of the girder a better stability is obtained for both upwards and downwards directed forces in connection with loads and gust of wind.

Furthermore the invention relates to a boxshaped girder of the type mentioned in the introductory part of claim 5 by way of example for use in a roof plate element according to the invention, which girder is distinctive in, that the compressive force plate consists of a steel plate, which—seen in cross section—is corrugated.

The overall height of the girder according to the invention may be further reduced, if the girder is such provided, that a bottom side part of said boxshaped girders—seen in cross section—also is corrugated.

In order to further improve the load capacity and the side stability of the girder according to the invention, it may be advantageously be such provided, that said compressive force steel plate has longitudinal, folded side edges extending downwards along opposite vertical sides of the girder.

The girder according to the invention is preferably such provided that the corrugation of said compressive force plate is trapezoid, or said corrugation of said compressive force plate may be wave-shaped.

The invention is explained in more detail in the following with reference to the drawing, in which:

BRIEF DESCRIPTION OF THE DRAWINGS

FIG. 3 shows a view—partly in section—of the girder part of the known roof plate element shown in FIG. 1, while

DETAILED DESCRIPTION OF THE PREFERRED EMBODIMENT

Figure 1:
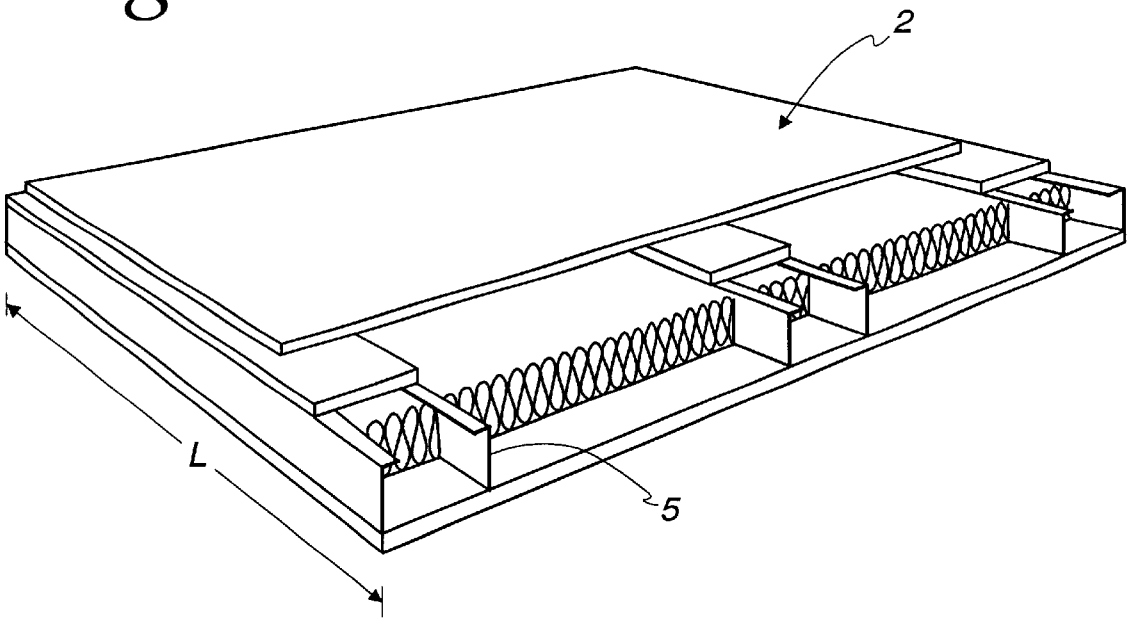
Fig. 1 (Prior Art)
FIG. 1 shows a perspective view of a known pre-manufactured roof plate element, cf., EP-A-1-0 675 990 (WO92/19826) of the same type as the roof plate element according to the invention.
Figure 2:
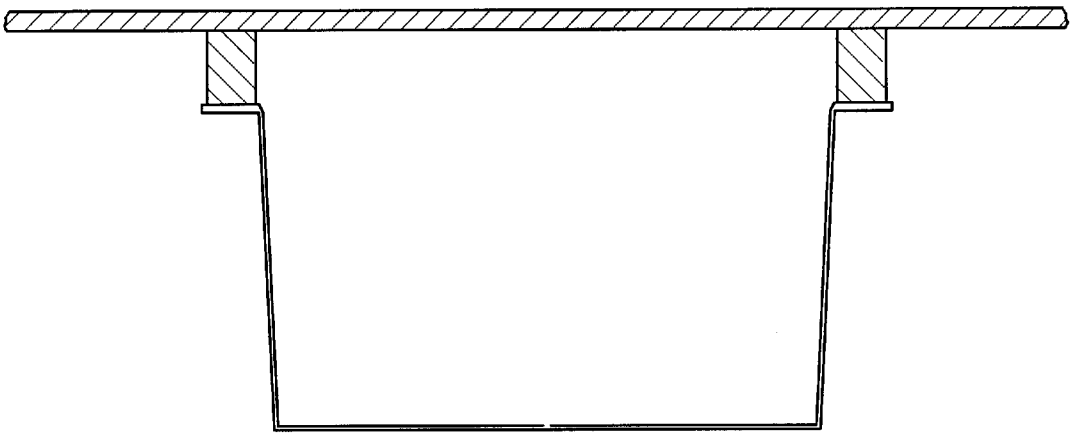
Fig. 2 (Prior Art)
FIG. 2 shows a view—partly in section—of another known roof plate element cf. NO-C-148 823 or DE-A1-25 20 255 with boxshaped girder of steel plate.
Figure 3:
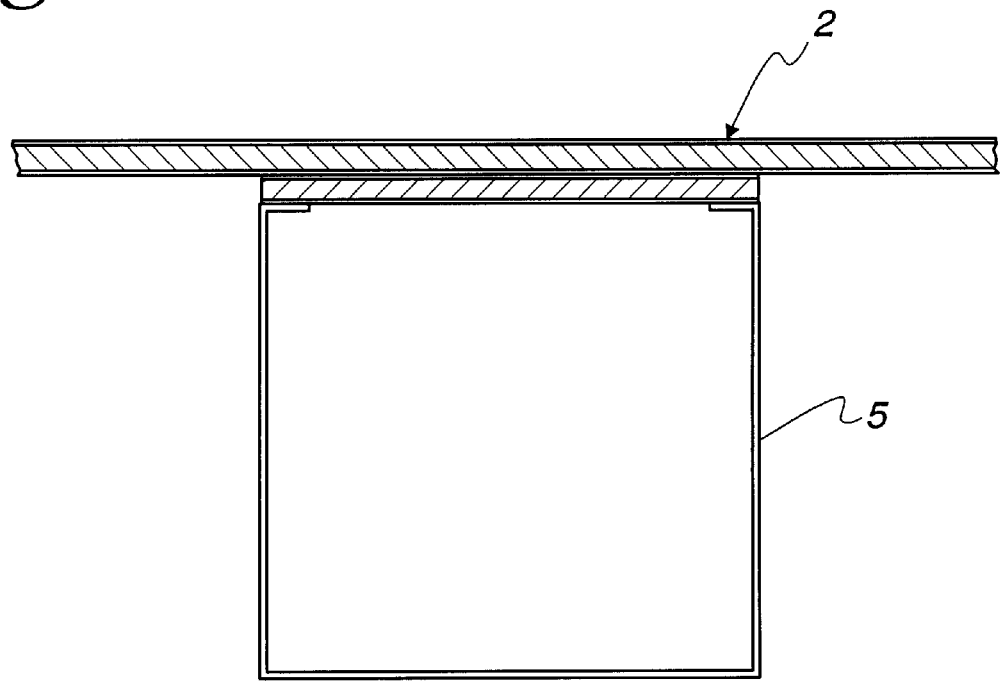

Like the roof plate element 3 shown in FIG. 1 and 3, the roof plate element according to the invention is manufactured with varying span of length L, which by the known pre-manufactured roof plate element varies from about 7,2–14,4 m, and the total thickness varies correspondingly between about 0,5–0,35 m which at the time was a considerable reduction of thickness or overall height in relation to the at that time known roof plate element, cf., FIG. 2, which has a maximum span of about 13,2 m thickness of 0,375 m.

In other words the development goes towards reducing the overall height of such premanufactured light roof plate elements by reducing the height of the boxshaped girder 5 consisting of electroplated steel plate. By the girder cf. FIG. 2 the upper side flanges are connected with the upper cover plywood plate by means of longitudinal laths, which by the roof plate element shown in FIGS. 1 and 3 are substituted by an extra plywood plate having the same width as the box-shaped girder 5, and constituting a compressive force top plate.

Figure 4:
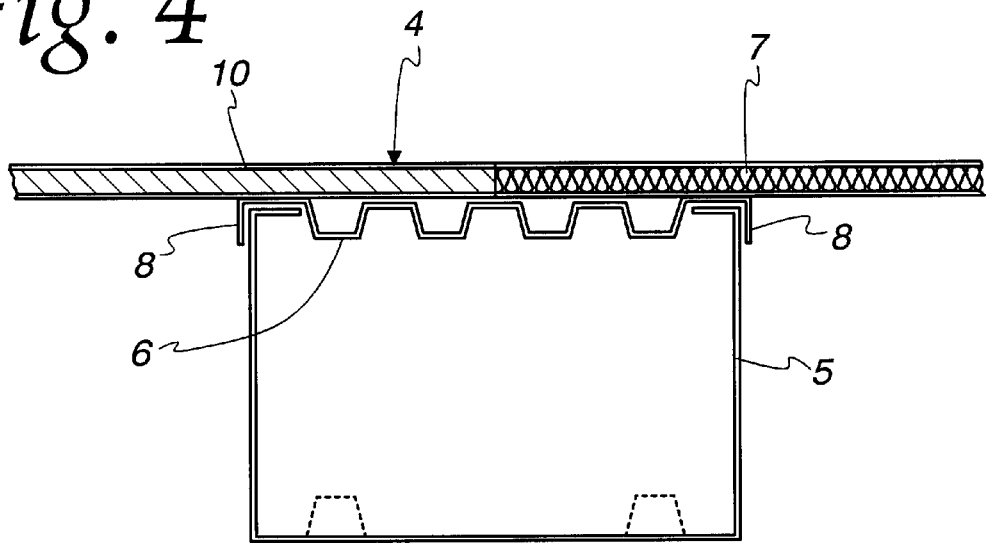
FIG. 4 shows a corresponding view—partly in section—of an embodiment for a girder by a roof plate element according to the invention.

By the embodiment for a premanufactured roof plate element 4 according to the invention shown in FIG. 4 the extra compressive force plywood plate is substituted by a corrugated top plate 6, which as shown has a trapez-corrugation; but which in principle may have any other form of corrugation, for instance wave-shaped corrugation.

The top plate 6 has at opposite side edges folded side edges 8, which give the top plate extra bending strength and which form a natural side limitation of the box-shaped girder 5 of the roof plate element. The shown side edges 8 may be possibly be avoided, which possibly makes it possible to use a trapezoid-corrugated steel plate, which just is cut in correct width with outer horizontal flanges, which are connected to folded-in side flanges of the box profile of the girder, for instance by means of self-cutting screws mounted from the top side of the cover plate 10. Corresponding thereto the shown side edges 8 make it possible to avoid the folded side flanges of the basic profile of the girder.

As indicated in claim 2 a bottom side part of the girder 5 by the roof plate element 4 according to the invention may be provided with a suitable corrugation, which would make a further reduction of thickness of the roof plate element possible.

The overall height or thickness of the roof plate element 4 according to the invention may at a span of about 14 m and with unchanged width of the girder 5 be reduced to about 0.2 m. With unchanged width and an overall height of 0.30 m the roof plate element and respectively the girder according to the invention may have a span of up to about 20 m.

However, it is of most importance that a roof plate element 4 according to the invention may be manufactured totally without use of organic material, that is totally without material, which because of humidity may be damaged because of rot.

By the known roof plate elements cf. for instance FIGS. 1, 2, and 3 the upper cover plate, usually consisting of plywood, consisting a compressive force plate, or carrying construction element. The same is the case by the said extra plywood plate by the roof plate element 2 shown in FIGS. 1 and 3, which also constitutes an important construction part.

Otherwise it is, however, by the roof plate element respectively the girder according to the invention, where the girder 5 in itself constitutes a self-carrying box girder, that is where the upper cover plate 10 is not included as a carrying construction part.

In other words, the girder 5 may be used as an independent lightweight carrying girder. As shown to the right in FIG. 3, a roof plate element 4 may consist of a number of girders 5 (for instance, with a mutual placing corresponding to FIG. 1) and where upper cover plates 7 are formed by hard insulation plates covered with roofing felt or roofing foil. Such a roof plate element according to the invention might downwardly be covered with, for instance, perforated steel plates secured directly to the underside of the girders 5, and thereby be included as carrying part of the roof construction.

What is claimed is:

1. A pre-manufactured roof plate element comprising a plurality of longitudinal boxshaped girders, each girder comprising vertical sides and a bottom side part made of steel plate, each girder being upwardly connected with a compressive force plate having substantially the same width as that of the girder, and said girders are positioned in each side and in the middle of the element, wherein said compressive force plate consists of a steel plate which is corrugated.

2. A roof plate element according to claim 1, wherein a bottom side part of said boxshaped girders also is corrugated.

3. A roof plate element according to claim 1, wherein said compressive force steel plate has longitudinal, folded side edges extending downwards along opposite vertical sides of the girder.

4. A roof plate element according to claim 1, wherein the corrugation of said compressive force plate is trapezoid.

5. A girder for by way of example a pre-manufactured roof plate element according to claim 1 and consisting of a boxshaped basic profile of steel plate and with an upper compressive force plate, wherein the compressive force plate consists of a steel plate which is corrugated.

6. A girder according to claim 5, where a bottom side part of said boxshaped girder also consists of a steel plate, which is corrugated.

7. A girder according to claim 5, wherein said compressive force steel plate has longitudinal, folded side edges extending downwards along opposite vertical sides of the girder.

8. A girder according to claim 5, wherein the corrugation of said compressive force plate is trapezoid.

* * * * *